US009364024B2

(12) United States Patent
Liu

(10) Patent No.: US 9,364,024 B2
(45) **Date of Patent: *Jun. 14, 2016**

(54) ELECTRONIC CIGARETTE HAVING A CONNECTOR FOR MAGNETIC CONNECTION

(71) Applicant: Qiuming Liu, Shenzhen (CN)

(72) Inventor: Qiuming Liu, Shenzhen (CN)

(73) Assignee: HUIZHOU KIMREE TECHNOLOGY CO., LTD., SHENZHEN BRANCH, Shenzhen, Guangdong Province (CN)

( * ) Notice: Subject to any disclaimer, the term of this patent is extended or adjusted under 35 U.S.C. 154(b) by 545 days.

This patent is subject to a terminal disclaimer.

(21) Appl. No.: 13/879,391

(22) PCT Filed: Dec. 5, 2012

(86) PCT No.: PCT/CN2012/085927

§ 371 (c)(1),
(2) Date: Apr. 12, 2013

(87) PCT Pub. No.: WO2014/085999

PCT Pub. Date: Jun. 12, 2014

(65) Prior Publication Data

US 2014/0150783 A1 Jun. 5, 2014

(51) Int. Cl.
*A24F 47/00* (2006.01)

(52) U.S. Cl.
CPC ..... *A24F 47/008* (2013.01)

(58) Field of Classification Search
CPC ..... A24F 47/008
USPC ..... 392/395
See application file for complete search history.

(56) References Cited

U.S. PATENT DOCUMENTS

2011/0011396 A1* 1/2011 Fang ..... A61M 15/06 128/202.21
2011/0303231 A1* 12/2011 Li ..... A24F 47/008 131/329
2013/0220315 A1* 8/2013 Conley ..... A61M 11/042 128/202.21

* cited by examiner

*Primary Examiner* — Michael H Wilson
*Assistant Examiner* — Eric Yaary
(74) *Attorney, Agent, or Firm* — Cheng-Ju Chiang

(57) ABSTRACT

The present invention relates to an electronic cigarette having a connector for magnetic connection, including a sucking rod and a power rod detachably connected with the sucking rod, wherein, the sucking rod includes a replaceable atomizer and a connector for connecting the atomizer and the power rod and transporting electricity of the power rod to the atomizer, the connector is magnetically connected with the atomizer, and detachably connected with the power rod. The electronic cigarette having a connector for magnetic connection of the present, can decrease manufacture and use cost of the electronic cigarette, and facilitate the installation, detachment and replacement of the electronic cigarette.

15 Claims, 8 Drawing Sheets

ELECTRONIC CIGARETTE HAVING A CONNECTOR FOR MAGNETIC CONNECTION

CROSS REFERENCE TO RELATED APPLICATIONS

The present application is a 35 U.S.C. §371 National Phase conversion of International (PCT) Patent Application No. PCT/CN2012/085927, filed on Dec. 5, 2012, the disclosure of which is incorporated by reference herein. The PCT International Patent Application was filed in Chinese.

TECHNICAL FIELD

This invention relates to an electronic cigarette field, and particularly to an electronic cigarette having a connector for magnetic connection.

DESCRIPTION OF BACKGROUND

Current electronic cigarettes comprises a sucking rod and a power rod, the sucking rod and the power rod are connected together by threads, the sucking rod is provided with a liquid smoke cup for accommodating liquid smoke, an atomizing means for changing the liquid smoke into smog and a connecting means for realizing the connection of the atomizing means and the power rod, and the liquid smoke cup, the atomizing means and the connecting means are integrally formed and inseparable. Since the sucking rod is an inseparable entirety, it is required to replace the whole sucking rod when the liquid smoke is used out, which results in relatively high manufacture and use cost of the sucking rod. Therefore, it is necessary to separately produced, to facilitate the installation, detachment and replacement of the atomizing means and the connecting means of the sucking rod.

SUMMARY

An object of the present invention is to provide an electronic cigarette having a connector for magnetic connection, to decrease manufacture and use cost of the electronic cigarette, and facilitate the installation, detachment and replacement of the electronic cigarette.

To achieve the above object, the present invention provides an electronic cigarette having a connector for magnetic connection, comprising a sucking rod and a power rod detachably connected with the sucking rod, wherein, the sucking rod comprises a replaceable atomizer and a connector for connecting the atomizer and the power rod and transporting electricity of the power rod to the atomizer, the connector is magnetically connected with the atomizer, and detachably connected with the power rod.

Wherein, the atomizer is configured with a first connecting mechanism at an end thereof mated with the connector, and the first connecting mechanism comprises a first seat which serves as a first electrode of the first connecting mechanism and a first pole which is installed on the first seat by means of a first insulating sleeve and servers as a second electrode of the first connecting mechanism; the connector is configured with a second connecting mechanism at one end thereof mated with the atomizer, the second connecting mechanism comprises a second seat which serves as a first electrode of the second connecting mechanism and a second pole which is installed on the second seat by means of a second insulating sleeve and serves as a second electrode of the second connecting mechanism, and the first seat entirely or partially forms a first magnetically-attracted portion and the second seat entirely or partially forms a second magnetically-attracted portion magnetically attracted the first magnetically-attracted portion; the first magnetically-attracted portion and the second magnetically-attracted portion magnetically attract each other so that the first seat and the second seat abut against each other and the first pole and the second pole abut against each other.

Wherein, the first seat is tubular-shaped, and the first pole is coaxially inserted into the first seat by means of the first insulating sleeve; and the second seat is tubular-shaped, and the second pole is coaxially inserted into the second seat by means of the second insulating sleeve.

Wherein, the second pole is inserted into the second insulating sleeve, the second insulating sleeve is fixed within the second seat, the second insulating sleeve is configured with an upper pole at an end thereof opposing the second pole for electrically connecting with an electrode of the power rod, the upper pole is clamped in the second insulating sleeve by means of a restraining sleeve, the second insulating sleeve is further configured with a spring therein, the spring has its opposite ends to respectively abut against the second pole and the upper pole so that the second pole and the upper pole are kept in a state of protruding out of the second insulating sleeve; correspondingly the power rod is configured with a lower pole at an end thereof connected with the connector to abut against the upper pole.

Wherein, the second insulating sleeve is a cylinder having a top wall and an opened end opposing the top wall, and comprises a side wall, the top wall and a flange radially outwardly extended from the top wall, the side wall and the top wall enclose an inner chamber for accommodating the spring, and the top wall further defines a pole hole for protrusion of the second pole.

Wherein, the second seat has a hollow tubular-shaped structure, and has its one end inserted into the connector and fixed into the connector, and its another end configured with an outer thread joint for connecting with the power rod, correspondingly the power rod is configured with an inner thread joint for engaging with the outer thread joint, the lower pole is configured in the inner thread joint, and the lower pole is fixed in the inner thread joint by means of an insulating sleeve; the power rod is configured with a power supply therein, and the inner thread joint and the lower pole are electrically connected with a first electrode and a second electrode of the power supply respectively.

Wherein, the second insulating sleeve is inserted into the second seat and fixed to the second seat by expanding its outer wall, simultaneously passes through a permanent magnet which defines a through hole coaxially extended therethrough, and fixes the permanent magnet to the second seat by means the flange thereof.

Wherein, the connector comprises a connecting casing for fixing the second connecting mechanism, the connecting casing is an axially extended tubular, the connecting casing has its one end configured with the second connecting mechanism, and its another end for insertion of the first connecting mechanism to be electrically connected with the second connecting mechanism.

Wherein, the atomizer comprises a sucking cylinder, a liquid smoke cup configured in the sucking cylinder for storing the liquid smoke and an atomizing mechanism for transforming the liquid smoke into smog, the atomizing mechanism has a first electrode and a second electrode to respectively electrically connect with the first electrode and the second electrode of the first connecting mechanism.

Wherein, the first seat has a cylindrical structure, and has its one end inserted into the sucking cylinder to fix the atomizing mechanism into the sucking cylinder; the first seat has its another end protruded out of the sucking cylinder so as to be inserted into the connecting casing together with the sucking cylinder and magnetically connected with the second connecting mechanism; the first seat is fixed to an inner wall of the sucking cylinder by expanding its outer wall; the first seat is configured with a fixing flange radially outwardly extended from a bottom portion thereof for being fit with a bottom extremity of the sucking cylinder; the first seat is configured with a locking ring on its inner wall for installing the first pole, and the first pole is fixed in the locking ring by means of the first insulating sleeve.

Wherein, the sucking cylinder comprises a main portion exposed from the connector and an inserting portion inserted into the connector to be connected with the connector, and a restraining step is configured between the main portion and the inserting portion, the inserting portion inserted into the connector is restrained by the restraining step.

Wherein, the atomizing mechanism comprises a heating wire, a fiber member for absorbing liquid smoke and supporting the heating wire, and an atomizing holder for supporting the fiber member, the heating wire is wound around the fiber member, the fiber member is accommodated and fixed in the atomizing holder, opposite ends of the heating wire pass through the atomizing holder and then are electrically connected with the first electrode and the second electrode in the connector; the atomizing holder is substantially cylindrical, and defines a locking slot therein for mounting the fiber member, and a vent coaxially extended therethrough, perforations are axially extended through two sides of the vent for the heating wire to pass through, the atomizing holder is fixed to an inner wall of the sucking cylinder by expanding its side wall, the atomizing holder abuts against the first seat by its another end opposing the locking slot and is fixed in the sucking cylinder by the first seat, and the fiber member abuts against the liquid smoke cup.

Wherein, the liquid smoke cup comprises a cup tube for storing the liquid smoke and a liquid guiding component for guiding the liquid smoke in the cup tube to the atomizing mechanism for atomization of the liquid smoke.

Wherein, the cup tube is a cup having one end opened and another end closed, and has a ring-shaped cross-section, and is integrally formed with the sucking cylinder; the liquid guiding component comprises an oil barrier disposed at a bottom of the cup tube and a liquid storing component affixed to a bottom of the oil barrier; the oil barrier defines plural liquid guiding holes, the oil barrier is firmly affixed to the opened end of the cup tube to seal the liquid smoke, the liquid storing component is fixed to an inner wall of the sucking cylinder by expanding its side wall, and has its one end firmly affixed to the oil barrier in order to fix the oil barrier to the bottom of the cup tube, and another end of the liquid storing component abuts against the atomizing mechanism, the liquid smoke is infiltrated from the cup tube via the oil barrier and absorbed by and stored in the liquid storing component, and further absorbed by the atomizing mechanism for atomization.

Wherein, the first magnetically-attracted portion is entirely made of a conductive magnet or magnetic material, or partially made of a conductive material; the second magnetically-attracted portion is entirely made of a conductive magnet or magnetic material, or partially made of a conductive material.

With the above technical solution, the electronic cigarette having a connector for magnetic connection of the present invention has the following technical advantages: firstly, the atomizer and the connector are independently manufactured, when the liquid smoke is used out, it is only required to replace the atomizer instead of the connector, this can save manufacture and use cost; secondly, the first connecting mechanism in the atomizer is inserted into the connector, and magnetically connected with the second connecting mechanism in the connector, assembly and detachment of the atomizer and the connector become very convenient; in addition, the second connecting mechanism is configured with the second pole and the upper pole which are always protruded out of the second insulating sleeve to respectively abut against the first electrode of the atomizer and the lower pole of the power rod, to make the connector to have reliable connection with the atomizer and the power rod. Furthermore, the liquid smoke cup is configured with a liquid guiding component at its bottom, which is combined with its oil barrier and liquid storing component, to achieve good liquid guiding effect. Finally, the electronic cigarette defines a special airflow channel therein, which achieves smooth air circulation inside and outside of the electronic cigarette.

The embodiments of the present invention are further described in detail as follows in conjunction with the accompanying drawings.

DETAILED DESCRIPTION OF THE EMBODIMENTS

It should be noted that, the embodiments and the characteristics in the embodiments can be mutually combined in case of no confliction. The embodiments of the present invention are further described in detail as follows in conjunction with the accompanying drawings.

Figure 1:
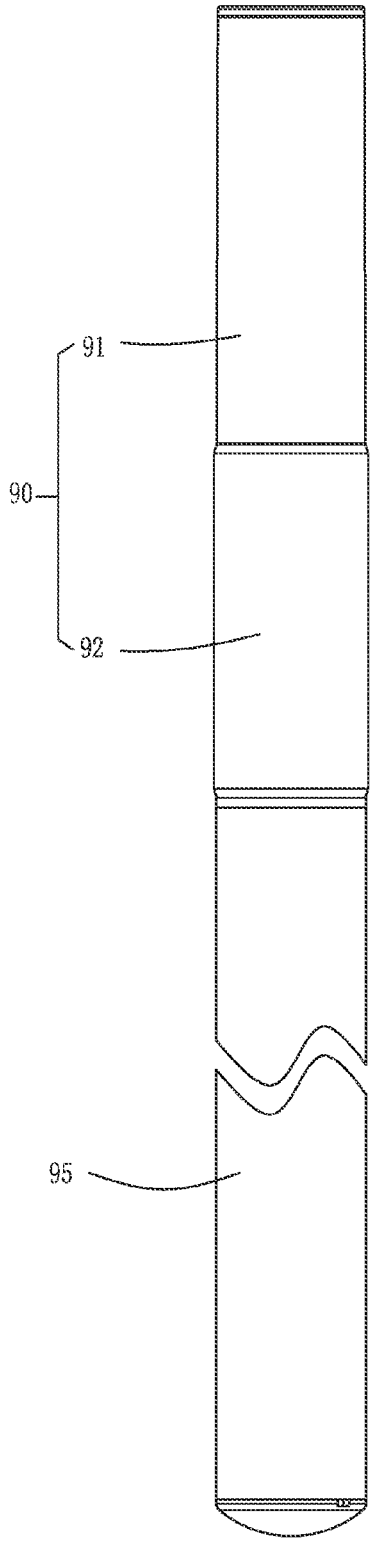
FIG. 1 is a front view of an electronic cigarette in accordance with an embodiment of the present invention.
Figure 2:
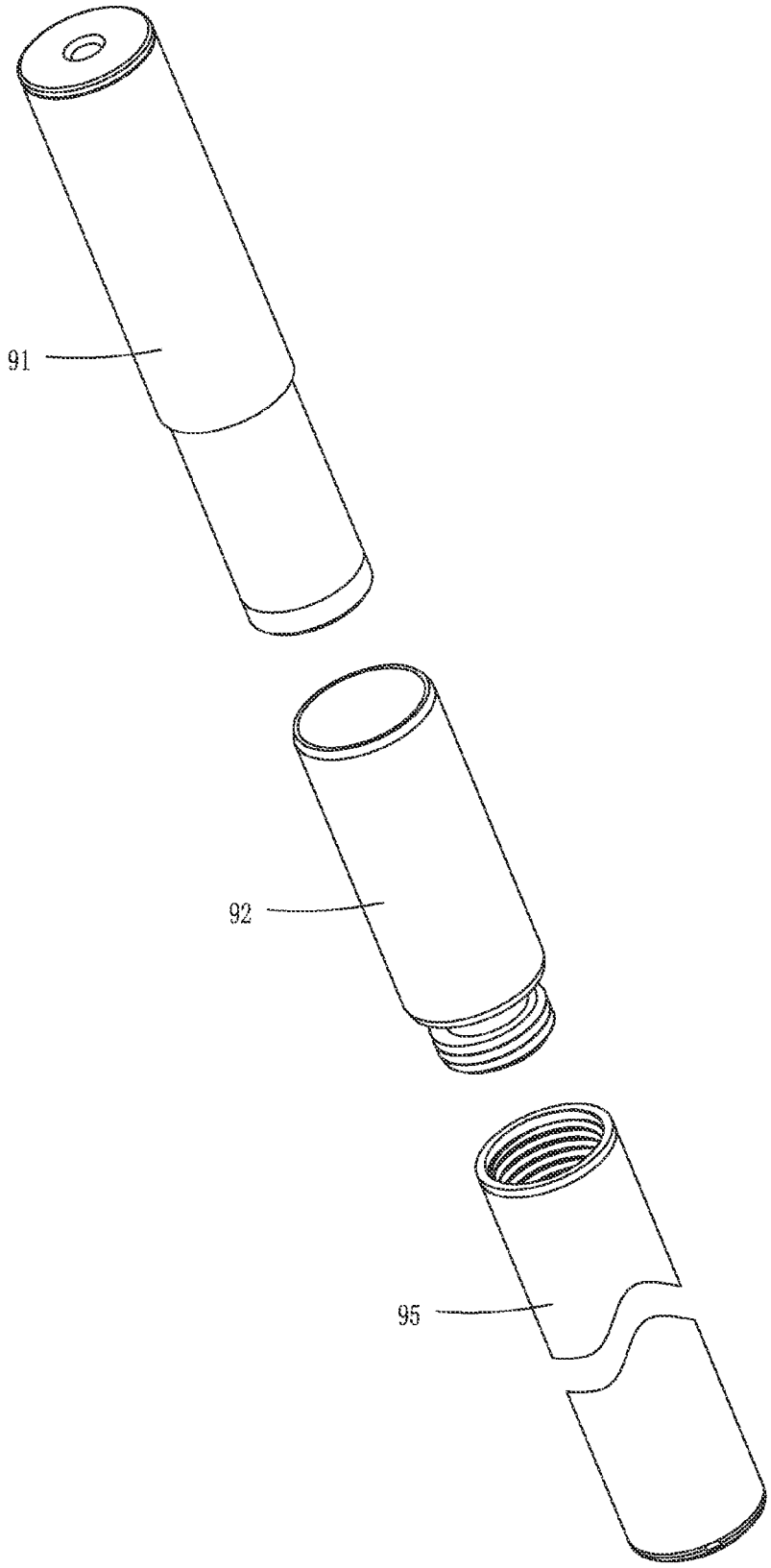
FIG. 2 is an exploded view of the electronic cigarette in accordance with the embodiment of the present invention.

As shown from FIG. 1 to FIG. 8, an embodiment of the present invention provides an electronic cigarette having a connector for magnetic connection. The electronic cigarette having a connector for magnetic connection comprises a sucking rod 90 and a power rod 95, the sucking rod 90 is constituted by an atomizer 91 and a connector 92 insertably assembled together, the connector 92 is located between the atomizer 91 and the power rod 95, for connecting the atomizer 91 and the power rod 95 and transporting the electricity of the power rod 95 to the atomizer 91. The connector 92 is magnetically connected with the atomizer 91, and detachably connected with the power rod 95. An end of the atomizer 91 mated with the connector 92 is configured with a first connecting mechanism 5, correspondingly, the connector 92 is configured with a second connecting mechanism 6 at its one end to engage with the first connecting mechanism 5 and the power rod 95, the atomizer 91 and the connector 92 is mutually connected together by magnetic adsorption, and the atomizer 91 and the connector 92 are magnetically connected in a manner of one inserting into another. FIG. 1 shows the orientation of the present embodiment with reference.

Figure 3:
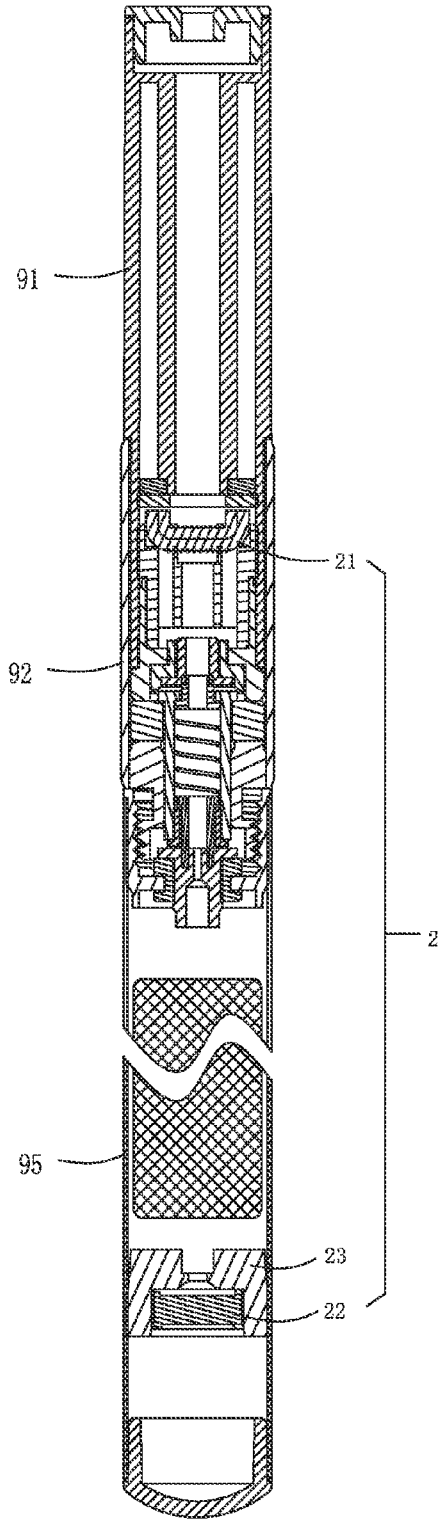
FIG. 3 is a cross-sectional view of the electronic cigarette in accordance with the embodiment of the present invention.
Figure 4:
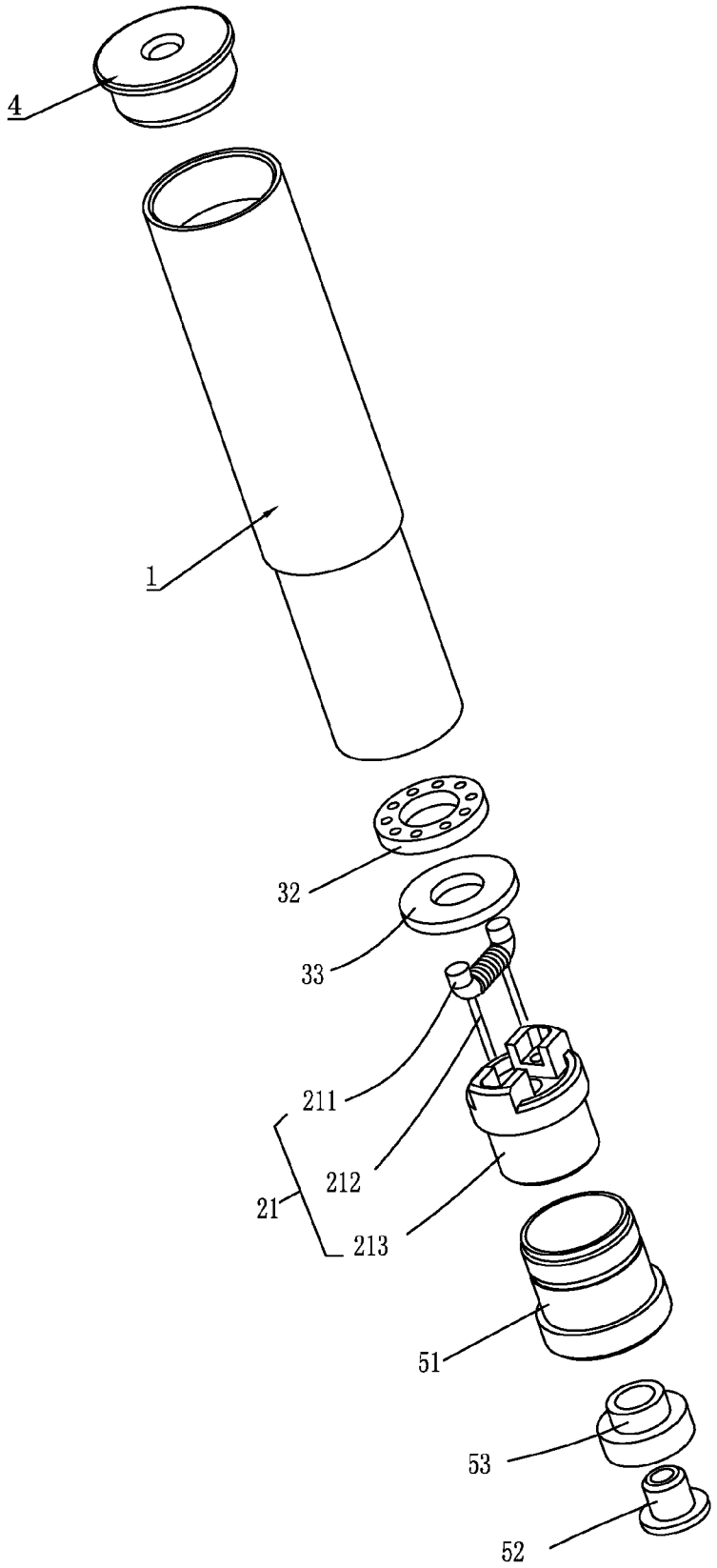
FIG. 4 is an exploded view of an atomizer of the electronic cigarette in accordance with the embodiment of the present invention.
Figure 5:
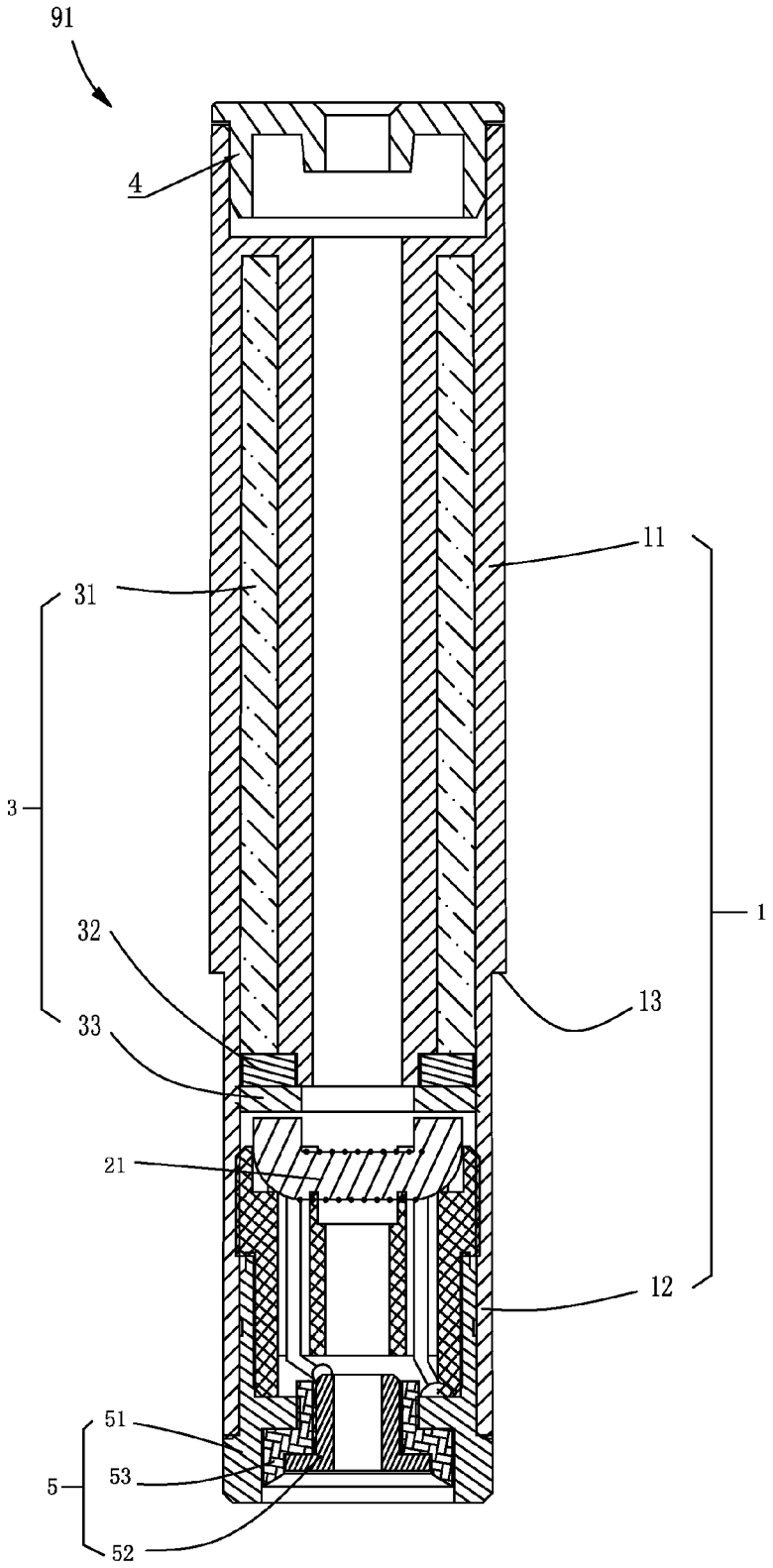
FIG. 5 is a cross-sectional view of the atomizer of the electronic cigarette in accordance with the embodiment of the present invention.

As shown in FIG. 3 and FIG. 5, the atomizer 91 comprises a hollow tubular-shaped sucking cylinder 1, an atomizing device 2, a liquid smoke cup 3, a nozzle cover 4 having a vent (not labeled) and the first connecting mechanism 5 connected with the connector 92. The nozzle cover 4 and the first connecting mechanism 5 are respectively installed at opposite ends of the sucking cylinder 1, and the atomizing device 2 and the liquid smoke cup 3 are located within the sucking cylinder 1. The sucking cylinder 1 comprises a main portion 11 exposed from the connector 92 and an inserting portion 12 inserted into the connector 92, and a restraining step 13 is configured between the main portion 11 and the inserting portion 12, the first connecting mechanism 5 is configured at an extremity of the of the inserting portion 12 of the sucking cylinder 1. The sucking cylinder 1 is defined with a vent axially extended therethrough.

The first connecting mechanism 5 comprises a first seat 51 as a first electrode of the first connecting mechanism 5, a first pole 52 as a second electrode of the first connecting mechanism 5 and a first insulating sleeve 53, and the first pole 52 defines a vent coaxially extended therethrough. The first pole 52 is fixedly sleeved by the first insulating sleeve 53, the first pole 52 is inserted into a central portion of the first seat by means of the first insulating sleeve 53, and the first pole 52 and the first insulating sleeve 53 constitutes a first pole unit. In this embodiment, the first seat 51 and the first pole 52 respectively serve as the first electrode (for example negative) and the second electrode (for example positive) of the first connecting mechanism 5. The first seat 51 is made of magnetic material such as iron material which can be absorbed by magnet, and is inserted into the sucking cylinder 1 to abut against an atomizing mechanism 21 of the atomizing device 2. The first seat 51 has its shape to be fit with an inner wall of the sucking cylinder 1, and is tubular-shaped, and is fixed onto an inner wall of the connecting end of the atomizer 91 by expanding its outer wall; the first seat 51 is configured with a fixing flange radially outwardly extended from a bottom portion thereof for being fit with a bottom extremity of the sucking cylinder 1; the first seat 51 is configured with a locking ring on its inner wall (not labeled) for installing the first pole 52, the first pole 52 is fixed in the locking ring by means of the first insulating sleeve 53, and the first pole 52 is defined with a vent coaxially extended therethrough.

The atomizing device 2 comprises the atomizing mechanism 21, a control board 22 and a board bracket 23 for accommodating and fixing the control board 22. In this embodiment, the atomizing mechanism 21 is disposed within the sucking cylinder 1, while the control board 22 and the board bracket 23 are disposed within the power rod 95. The control board 22 is provided with a miniature pneumatic switch for controlling the atomizing mechanism 21 to work.

The atomizing mechanism 21 is for transforming the liquid smoke into smog, and comprises a heating wire 211, a fiber member 212 for absorbing liquid smoke and supporting the heating wire 211, and an atomizing holder 213 for supporting the fiber member 212. The heating wire 211 is wound around the fiber member 212, and the fiber member 212 is capable of absorbing water and reserving water like a sponge, and is capable of being made of fiberglass or a material having liquid-absorbent and liquid barrier properties such as cotton material. In this embodiment, the fiber member 212 is accommodated and fixed in the atomizing holder 213, opposite ends of the heating wire 211 pass through the atomizing holder 213 and then are electrically connected with the positive and the negative. The atomizing holder 213 is substantially cylindrical, and defines a locking slot (not labeled) therein for mounting the fiber member 212. The atomizing holder 213 is defined with a vent coaxially extended therethrough, and perforations (not labeled) axially extended through two sides of the vent for the heating wire to pass through. The atomizing holder 213 is fixed to the inner wall of the sucking cylinder 1 by expanding its side wall. The atomizing holder 213 abuts against the first seat 51 at its another end opposing the locking slot and is fixed in the sucking cylinder 1 by the first seat 51, so that the fiber member 212 abuts against the liquid smoke cup 3 to absorb the liquid smoke out of the liquid smoke cup 3.

The liquid smoke cup 3 comprises a cup tube 31 for storing the liquid smoke and a liquid guiding component (not labeled) for guiding the liquid smoke in the cup tube 31 to the atomizing mechanism 21 for atomization of the liquid smoke. The cup tube 31 is a cup having one end opened and another end closed, and has a ring-shaped cross-section, and is integrally formed with the sucking cylinder 1. The liquid guiding component comprises an oil barrier 32 disposed at a bottom of the cup tube 31 and a liquid storing component 33 affixed to a bottom of the oil barrier 32. The oil barrier 32 defines plural liquid guiding holes, and flow volume of the liquid smoke depends on the size and amount of the liquid guiding holes. The oil barrier 32 is firmly affixed to the opened end of the cup tube 31 to seal the liquid smoke. The liquid storing component 33 is also capable of absorbing water and reserving water like a sponge, and is made of a material which has heat-resistance and liquid-absorbent and liquid barrier properties. The liquid storing component 33 is fixed to the inner wall of the sucking cylinder 1 by expanding its side wall, and has its one end firmly affixed to the oil barrier 32 in order to fix the oil barrier 32 to the bottom of the cup tube 31, and another end of the liquid storing component 33 abuts against the fiber member 212. The liquid smoke is infiltrated from the cup tube 31 via the oil barrier 32 and absorbed by and stored in the liquid storing component 33, and further absorbed by the fiber member 212 for the heating wire 211 to atomize it.

Figure 6:
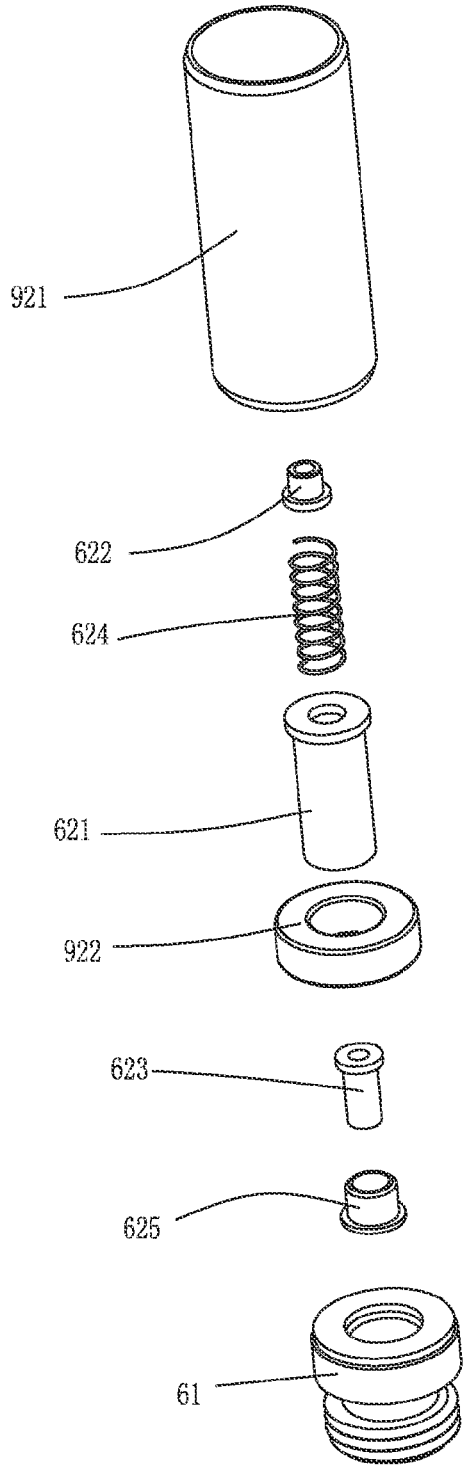
FIG. 6 is an exploded view of a connector of the electronic cigarette in accordance with the embodiment of the present invention.
Figure 7:
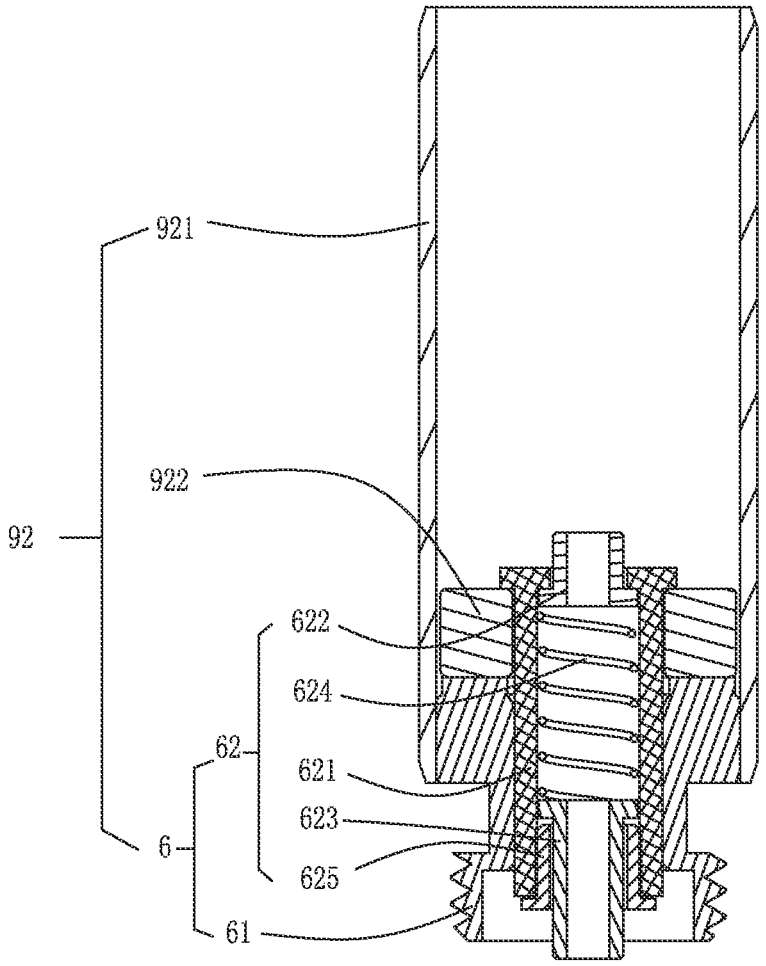
FIG. 7 is a cross-sectional view of the connector of the electronic cigarette in accordance with the embodiment of the present invention.

As shown in FIG. 6 and FIG. 7, the connector 92 is whole tubular-shaped, and comprises a connecting casing 921, and the second connecting mechanism 6 connected with the first connecting mechanism 5 is configured at an end of the connecting casing 921 connected with the atomizer 91. The second connecting mechanism 6 comprises a second seat 61 as a first electrode of the second connecting mechanism 6, a second pole unit 62 configured in the second seat 61 and a permanent magnet 922. The second pole unit 62 is inserted into the second seat 61 and fixes the permanent magnet 922 into the second seat 61.

The second seat 61 has a hollow tubular-shaped structure, and has its one end inserted into the connecting casing 921 and fixed into the connecting casing 921, and its another end configured with an outer thread joint for connecting with the power rod 95. The second pole unit 62 comprises a second insulating sleeve 621, a second pole 622 and an upper pole 623 respectively configured at opposite ends of the second insulating sleeve 621 but always protruded out of the second insulating sleeve 621, a spring 624 configured within the second insulating sleeve 621 and having its opposite ends to respectively abut against the second pole 622 and the upper pole 623 so that they are always protruded out of the second insulating sleeve 621, and a restraining sleeve 625 facilitating to settle the upper pole 623 to the corresponding end of the second insulating sleeve 621. The second pole 622 and the upper pole 623 both define a vent coaxially extended therethrough, and the second pole 622 serves as the second electrode of the second connecting mechanism. The second pole unit 62 constituted by the second insulating sleeve 621, the second pole 622, the upper pole 623, the spring 624 and the restraining sleeve 625, ensures a reliable connection of the connector 92 with the atomizer 91 and the power rod 95 respectively.

The second insulating sleeve 621 is substantially cup-shaped, and is made of insulating material, and comprises a side wall, a top wall and an inner chamber enclosed by the side wall and the top wall for accommodating the spring 624. The second insulating sleeve 621 has an opened end opposing its top wall, and defines a pole hole (not labeled) in the top wall for protrusion of the second pole 622. The top wall forms a flange (not labeled) radially outwardly extended therefrom. The second insulating sleeve 621 passes through the permanent magnet and is inserted into the second seat 61 and fixed to the second seat 61 by expanding its outer wall, and simultaneously fixes the permanent magnet 922 to the second seat 61 by means of the flange.

The restraining sleeve 625 is substantially cylinder-shaped, and defines a through hole (not labeled) coaxially extended therethrough, and forms a restraining flange (not labeled) outwardly extended in a radial direction from a side wall of its end portion. The restraining sleeve 625 is inserted into the second insulating sleeve 621 and engaged with a side wall of the inner chamber of the second insulating sleeve 621 by expanding its side wall, and restrained by the restraining flange. The through hole is for the upper pole 623 to protrude out of the restraining sleeve 625, i.e., out of the second insulating sleeve 621.

The permanent magnet 922 has a circular structure, and the permanent magnet 922 defines a central through hole (not labeled) therein for the second insulating sleeve 621 to pass through, and the permanent magnet 922 is fixed in the second connecting mechanism 6.

The first seat 51 entirely or partially forms a first magnetically-attracted portion. In this embodiment, the first seat 51 entirely serves as the first magnetically-attracted portion. The second seat 61 entirely or partially forms a second magnetically-attracted portion for magnetically attracting the first magnetically-attracted portion. In order to facilitate better positioning and fixing when the second seat 61 of the connector is mated with the first seat 51 of the atomizer, the first seat 51 is capable of being made of a conductive magnet or magnetic material, and the magnetic material may be an iron material, so that the first seat 51 constitutes the first magnetically-attracted portion, instead, the first seat 51 can also be configured with an independent component made of a conductive magnet or magnetic material that servers as the first magnetically-attracted portion; or part of the first magnetically-attracted portion is made of a conductive material. Correspondingly, the second seat 61 is also capable of being made of a conductive magnet or magnetic material, so that the second seat 61 entirely constitutes the second magnet for magnetically attracting the first magnetically-attracted portion of the first seat 51, instead, the second seat 51 can also be configured with an independent component made of a conductive magnet or magnetic material that servers as the second magnetically-attracted portion, or the second magnetically-attracted portion is partially constituted by a conductive material. Therefore, the matching relationship between the first magnetically-attracted portion and the second magnetically-attracted portion can be magnet and magnet, magnet and magnetic material, or magnetic material and magnet.

As shown in FIG. 3, when the first connecting mechanism 5 of the atomizer 91 is inserted into the connecting casing 921 of the connector 92 to the right place, the first seat 51 has its one end to abut against or be close to the permanent magnet 922 of the second connecting mechanism 6. Because of the magnetic force of the permanent magnet 922, the first seat 51 is firmly attracted by the permanent magnet 922 but cannot be easily detached from the connector 91, the second pole 622 of the second connecting mechanism 6 is slightly retracted for it is abutted against by an end face of the first pole 52 of the first connecting mechanism 5 to overcome the elastic force of the spring 624, to ensure the first pole 52 and the second pole 622 in good contact with each other; moreover, the side wall of the first seat 51 and the inner wall of the connecting casing 921 circumferentially contact with each other to realize conduction therebetween, to thereby achieve corresponding conduction of inner circuits of the atomizer 91 and the connector 92.

Figure 8:
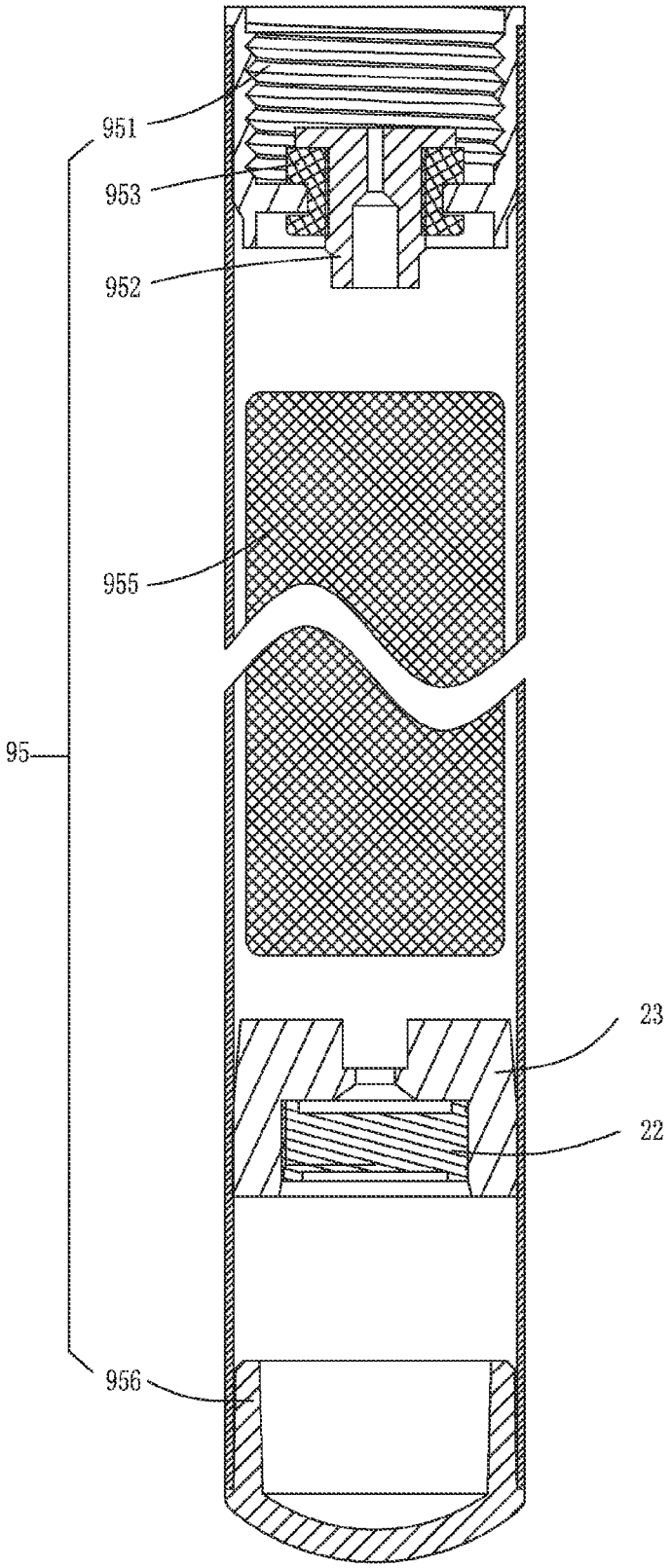
FIG. 8 is a cross-sectional view of a power rod of the electronic cigarette in accordance with the embodiment of the present invention.

As shown in FIG. 8, the power rod 95 is substantially tubular-shaped, and its end connected with the connector 92 is configured with an inner thread joint 951 mating with the outer thread joint, the inner thread joint 951 is configured with a lower pole 952 therein to abut against the upper pole 623 for conduction, and the lower pole 952 is fixed in the inner thread joint 951 by means of an insulating sleeve 953; the lower pole 952 defines a vent coaxially extended therethrough. The inner thread joint 951 and the lower pole 951 respectively serve as a first electrode and a second electrode of the power rod 95. The power rod 95 is configured with a storage battery 955 and so on. The storage battery 955 has its first electrode and second electrode to be respectively electrically connected with the inner thread joint 951 and the lower pole 952. The power rod 95 has its another end configured with an end cap 956, and the end cap 956 is configured with an indicator light and intake holes (not shown).

Additionally, as shown in FIG. 3, external air enters the power rod 95 via the intake holes of end cap 956 which disposed at a bottom of the power rod, and goes into the second insulating sleeve 621 after passes by the lower pole 952 and the vent of the upper pole 623, and then enters the atomizer 91 in turn through the vents of the second pole 622 and the first pole 52, and then passes by the vent of the atomizing holder 213 and the vent of the sucking cylinder 1, finally flows out of the sucking rod 90 via the vent of the nozzle cover 4. Summarily, there is a special airflow channel defined inside of the electronic cigarette, which achieves smooth air circulation inside and outside of the electronic cigarette. Certainly, external air can also enter the atomizer 91 directly via the vent of the nozzle cover 4.

Though the embodiments of the present invention have been illustrated and described, it should be noted that, the embodiments and the characteristics in the embodiments can be mutually combined in case of no confliction. For the persons of ordinary skill in this field, various changes, modifications, replacement and variations within the principle and spirit of the present invention can be made to the embodiments; the protecting scope of the present invention is defined by the appended claims and their equivalents.

What is claimed is:

1. An electronic cigarette having a connector for magnetic connection, comprising a sucking rod and a power rod detachably connected with the sucking rod, wherein, the sucking rod comprises a replaceable atomizer and a connector for connecting the atomizer and the power rod and transporting electricity of the power rod to the atomizer, the connector is magnetically connected with the atomizer, and detachably connected with the power rod;

the atomizer is configured with a first connecting mechanism at an end thereof mated with the connector;

the connector is configured with a second connecting mechanism at one end thereof mated with the atomizer, the second connecting mechanism comprises a second seat which serves as a first electrode of the second connecting mechanism and a second pole which is installed on the second seat by means of a second insulating sleeve and serves as a second electrode of the second connecting mechanism;

the second pole is inserted into the second insulating sleeve, the second insulating sleeve is configured with an upper pole at an end thereof opposing the second pole for electrically connecting with an electrode of the power rod, the second insulating sleeve is further configured with a spring therein, the spring has its opposite ends to respectively abut against the second pole and the upper pole so that the second pole and the upper pole are kept in a state of protruding out of the second insulating sleeve; correspondingly the power rod is configured with a lower pole at an end thereof connected with the connector to abut against the upper pole.

2. The electronic cigarette having a connector for magnetic connection as described in claim 1, wherein the first connecting mechanism comprises a first seat which serves as a first electrode of the first connecting mechanism and a first pole which is installed on the first seat by means of a first insulating sleeve and serves as a second electrode of the first connecting mechanism; and the first seat entirely or partially forms a first magnetically-attracted portion and the second seat entirely or partially forms a second magnetically-attracted portion magnetically attracted the first magnetically-attracted portion; the first magnetically-attracted portion and the second magnetically-attracted portion magnetically attract each other so that the first seat and the second seat abut against each other and the first pole and the second pole abut against each other.

3. The electronic cigarette having a connector for magnetic connection as described in claim 2, wherein, the first seat is tubular-shaped, and the first pole is coaxially inserted into the first seat by means of the first insulating sleeve; and the second seat is tubular-shaped, and the second pole is coaxially inserted into the second seat by means of the second insulating sleeve.

4. The electronic cigarette having a connector for magnetic connection as described in claim 3, wherein, the second insulating sleeve is fixed within the second seat, the upper pole is clamped in the second insulating sleeve by means of a restraining sleeve.

5. The electronic cigarette having a connector for magnetic connection as described in claim 1, wherein, the second insulating sleeve is a cylinder having a top wall and an opened end opposing the top wall, and comprises a side wall, the top wall and a flange radially outwardly extended from the top wall, the side wall and the top wall enclose an inner chamber for accommodating the spring, and the top wall further defines a pole hole for protrusion of the second pole.

6. The electronic cigarette having a connector for magnetic connection as described in claim 1, wherein, the second seat has a hollow tubular-shaped structure, and has its one end inserted into the connector and fixed into the connector, and its other end configured with an outer thread joint for connecting with the power rod, correspondingly the power rod is configured with an inner thread joint for engaging with the outer thread joint, the lower pole is configured in the inner thread joint, and the lower pole is fixed in the inner thread joint by means of an insulating sleeve; the power rod is configured with a power supply therein, and the inner thread joint and the lower pole are electrically connected with a first electrode and a second electrode of the power supply respectively.

7. The electronic cigarette having a connector for magnetic connection as described in claim 1, wherein, the second insulating sleeve is inserted into the second seat and fixed to the second seat by expanding its outer wall, simultaneously passes through a permanent magnet which defines a through hole coaxially extended therethrough, and fixes the permanent magnet to the second seat by means the flange thereof.

8. The electronic cigarette having a connector for magnetic connection as described in claim 2, wherein, the connector comprises a connecting casing for fixing the second connecting mechanism, the connecting casing is an axially extended tube, the connecting casing has its one end configured with the second connecting mechanism, and its other end for insertion of the first connecting mechanism to be electrically connected with the second connecting mechanism.

9. The electronic cigarette having a connector for magnetic connection as described in claim 8, wherein, the atomizer comprises a sucking cylinder, a liquid smoke cup configured in the sucking cylinder for storing the liquid smoke and an atomizing mechanism for transforming the liquid smoke into smog, the atomizing mechanism has a first electrode and a second electrode to respectively electrically connect with the first electrode and the second electrode of the first connecting mechanism.

10. The electronic cigarette having a connector for magnetic connection as described in claim 9, wherein, the first seat has a cylindrical structure, and has its one end inserted into the sucking cylinder to fix the atomizing mechanism into the sucking cylinder; the first seat has its other end protruded out of the sucking cylinder so as to be inserted into the connecting casing together with the sucking cylinder and magnetically connected with the second connecting mechanism; the first seat is fixed to an inner wall of the sucking cylinder by expanding its outer wall; the first seat is configured with a fixing flange radially outwardly extended from a bottom portion thereof for being fit with a bottom extremity of the sucking cylinder; the first seat is configured with a locking ring on its inner wall for installing the first pole, and the first pole is fixed in the locking ring by means of the first insulating sleeve.

11. The electronic cigarette having a connector for magnetic connection as described in claim 9, wherein, the sucking cylinder comprises a main portion exposed from the connector and an inserting portion inserted into the connector to be connected with the connector, and a restraining step is configured between the main portion and the inserting portion, the inserting portion inserted into the connector is restrained by the restraining step.

12. An electronic cigarette having a connector for magnetic connection, comprising a sucking rod and a power rod detachably connected with the sucking rod, wherein, the sucking rod comprises a replaceable atomizer and a connector for connecting the atomizer and the power rod and transporting electricity of the power rod to the atomizer, the connector is magnetically connected with the atomizer, and detachably connected with the power rod;

the atomizer is configured with a first connecting mechanism at an end thereof mated with the connector; and the first connecting mechanism comprises a first seat which serves as a first electrode of the first connecting mechanism and a first pole which is installed on the first seat by means of a first insulating sleeve and serves as a second electrode of the first connecting mechanism;

the atomizer comprises a sucking cylinder, a liquid smoke cup configured in the sucking cylinder for storing the liquid smoke and an atomizing mechanism for transforming the liquid smoke into smog;

the atomizing mechanism comprises a heating wire, a fiber member for absorbing liquid smoke and supporting the heating wire, and an atomizing holder for supporting the fiber member, the heating wire is wound around the fiber member, the fiber member is accommodated and fixed in the atomizing holder, opposite ends of the heating wire pass through the atomizing holder and then are electrically connected with the connector;

the atomizing holder is substantially cylindrical, and defines a locking slot therein for mounting the fiber member, and a vent coaxially extended therethrough, perforations are axially extended through two sides of the vent for the heating wire to pass through, the atomizing holder is fixed to an inner wall of the sucking cylinder by expanding its side wall, the atomizing holder abuts against the first seat by its other end opposing the locking slot and is fixed in the sucking cylinder by the first seat, and the fiber member abuts against the liquid smoke cup.

13. The electronic cigarette having a connector for magnetic connection as described in claim 9, wherein, the liquid smoke cup comprises a cup tube for storing the liquid smoke and a liquid guiding component for guiding the liquid smoke in the cup tube to the atomizing mechanism for atomization of the liquid smoke.

14. An electronic cigarette having a connector for magnetic connection, comprising a sucking rod and a power rod detachably connected with the sucking rod, wherein, the sucking rod comprises a replaceable atomizer and a connector for connecting the atomizer and the power rod and transporting electricity of the power rod to the atomizer, the connector is magnetically connected with the atomizer, and detachably connected with the power rod;

the atomizer comprises a sucking cylinder, a liquid smoke cup configured in the sucking cylinder for storing the liquid smoke and an atomizing mechanism for transforming the liquid smoke into smog;

the liquid smoke cup comprises a cup tube for storing the liquid smoke and a liquid guiding component for guiding the liquid smoke in the cup tube to the atomizing mechanism for atomization of the liquid smoke;

the cup tube is a cup having one end opened and another end closed, and has a ring-shaped cross-section, and is integrally formed with the sucking cylinder; the liquid guiding component comprises an oil barrier disposed at a bottom of the cup tube and a liquid storing component affixed to a bottom of the oil barrier; the oil barrier defines plural liquid guiding holes, the oil barrier is firmly affixed to the opened end of the cup tube to seal the liquid smoke, the liquid storing component is fixed to an inner wall of the sucking cylinder by expanding its side wall, and has its one end firmly affixed to the oil barrier in order to fix the oil barrier to the bottom of the cup tube, and another end of the liquid storing component abuts against the atomizing mechanism, the liquid smoke is infiltrated from the cup tube via the oil barrier and absorbed by and stored in the liquid storing component, and further absorbed by the atomizing mechanism for atomization.

15. The electronic cigarette having a connector for magnetic connection as described in claim 2, wherein, the first magnetically-attracted portion is entirely made of a conductive magnet or magnetic material, or partially made of a conductive material; the second magnetically-attracted portion is entirely made of a conductive magnet or magnetic material, or partially made of a conductive material.

* * * * *